US010139164B2

(12) United States Patent
Mandai et al.

(10) Patent No.: US 10,139,164 B2
(45) Date of Patent: Nov. 27, 2018

(54) ROTARY HEAT TREATMENT FURNACE

(71) Applicants: SANKEN SANGYO CO., LTD., Hiroshima-shi, Hiroshima (JP); CENTRAL MOTOR WHEEL CO., LTD., Anjo-shi, Aichi (JP)

(72) Inventors: Yusuke Mandai, Hiroshima (JP); Tsukasa Kishimura, Hiroshima (JP); Fumito Inuzuka, Nishio (JP)

(73) Assignees: SANKEN SANGYO CO., LTD., Hiroshima (JP); CENTRAL MOTOR WHEEL CO., LTD., Aichi (JP)

( * ) Notice: Subject to any disclaimer, the term of this patent is extended or adjusted under 35 U.S.C. 154(b) by 336 days.

(21) Appl. No.: 15/198,681

(22) Filed: Jun. 30, 2016

(65) Prior Publication Data

US 2016/0313061 A1 Oct. 27, 2016

Related U.S. Application Data

(63) Continuation of application No. PCT/JP2014/084539, filed on Dec. 26, 2014.

(30) Foreign Application Priority Data

Jan. 7, 2014 (JP) ..... 2014-01196

(51) Int. Cl.
*F27B 7/02* (2006.01)
*F27B 9/10* (2006.01)
(Continued)

(52) U.S. Cl.
CPC ..... *F27B 7/02* (2013.01); *C21D 9/0037* (2013.01); *F27B 7/14* (2013.01); *F27B 7/20* (2013.01);
(Continued)

(58) Field of Classification Search
CPC ..... F27B 7/02
(Continued)

(56) References Cited

U.S. PATENT DOCUMENTS

2007/0205544 A1* 9/2007 Komrowski ..... C21B 13/0073 266/249
2008/0003534 A1* 1/2008 Takano ..... C21D 1/00 432/253
2012/0009536 A1* 1/2012 Ebner ..... C21D 9/677 432/9

FOREIGN PATENT DOCUMENTS

JP 2004-257658 9/2004
JP 2011-007471 1/2011

OTHER PUBLICATIONS

Office Action issued by The State Intellectual Property Office of the People's Republic of China in relation to Chinese Patent Application No. 201480070318.5 dated Jan. 6, 2017 (3 pages).
(Continued)

*Primary Examiner* — Steven B McAllister
*Assistant Examiner* — John Bargero
(74) *Attorney, Agent, or Firm* — Robert P. Michal, Esq.; Carter, DeLuca, Farrell & Schmidt, LLP

(57) ABSTRACT

A furnace includes: a furnace body; a housing rotary body including a plurality of side walls, a plurality of housing chambers partitioned by the side walls and disposed circumferentially in multiple stages, each including multiple housing chambers, and a space disposed in the central portion of the housing rotary body to provide a donut shape in plan view; a rotary driving device for rotating the housing rotary body; a heating device for heating the air inside the furnace body; a first and a second partition wall which together partition the inside of the furnace body into the first and the second zone; a first flow passage communicating a blowout port of the fan with outer circumference sides of the housing
(Continued)

chambers in the first zone; and a second flow passage communicating outer circumference sides of the housing chambers in the second zone with a suction port of the fan.

9 Claims, 5 Drawing Sheets

(51) Int. Cl.

| | |
|---|---|
| ***F27B 9/16*** | (2006.01) |
| ***C21D 9/00*** | (2006.01) |
| ***F27D 99/00*** | (2010.01) |
| ***F27B 7/14*** | (2006.01) |
| ***F27B 7/20*** | (2006.01) |
| ***F27B 7/30*** | (2006.01) |
| *F27D 7/04* | (2006.01) |

(52) U.S. Cl.
CPC ..... *F27B 7/30* (2013.01); *F27B 9/10* (2013.01); *F27B 9/16* (2013.01); *F27D 99/0033* (2013.01); *F27D 2007/045* (2013.01)

(58) Field of Classification Search
USPC ..... 432/117, 253; 414/588
See application file for complete search history.

(56) References Cited

OTHER PUBLICATIONS

Search Report issued by The State Intellectual Property Office of the People's Republic of China in relation to Chinese Patent Application No. 201480070318.5 dated Dec. 28, 2017 (2 pages).

* cited by examiner

ROTARY HEAT TREATMENT FURNACE

CROSS REFERENCE TO RELATED APPLICATION

This is a continuation application of International Application No. PCT/JP2014/084539, filed on Dec. 26, 2014, which claimed the priority of Japanese Application No. 2014-001196 filed on Jan. 7, 2014, the entire content of which is incorporated herein by reference.

TECHNICAL FIELD

The present invention relates to a rotary heat treatment furnace that applies heat treatment with circulating hot air to heating targets such as an aluminum alloy.

BACKGROUND OF THE INVENTION

Heat treatment furnaces of a hot air circulating type and a multistage-hearth rotation type have been used to apply heat treatment to heating targets such as an aluminum alloy, for example. The former hot air circulating type has an advantage of reducing a temperature variation inside a furnace, while the latter multistage-hearth rotation type has an advantage of saving a space of a heat treatment facility.

The applicant of the present application has filed a patent application involving a rotary heat treatment furnace in which the hot air circulating type is combined with the multistage-hearth rotation type (refer to Japanese Unexamined Patent Publication No. 2011-7471, for example).

As illustrated in FIG. 4, the rotary heat treatment furnace 10 includes a furnace body 11 incorporating a housing rotary body 12 provided with housing chambers 12*a* and a central portion 12*b*. The furnace 10 also includes hollow chambers 70 that correspond to the respective housing chambers 12*a*. Hot air fed to the central portion 12*b* from thereabove is supplied to all heating targets 100 through the hollow chambers 70.

The rotary heat treatment furnace 10 disclosed in Japanese Unexamined Patent Publication No. 2011-7471 is such that the hot air for heating the heating targets 100 is not priory used to heat objects other than the heating targets 100. Thus, the hot air supplied to each of the heating targets 100 has a substantially same temperature, whereby all the heating targets 100 can be heated evenly.

Other than the furnace described above, another style of rotary heat treatment furnace is disclosed that supplies hot air to heating targets 100 from therebelow (refer to Japanese Unexamined Patent Publication No. 2004-257658, for example).

As illustrated in FIG. 5, this rotary heat treatment furnace 20 includes a fan 24 provided to an upper part of a central portion thereof. Hot air is first sent by the fan 24 to the bottom of the furnace, and is fed to a housing chamber 22*a* at the lowest position and consecutively to a housing chamber 22*a* at the highest position. The hot air passed through the highest housing chamber is again sent to the bottom of the furnace by the fan 24.

PATENT LITERATURE

Summary of Invention

However, each of the furnaces of the prior inventions described above is configured to send the hot air in the central portion from the upper part thereof to the lower part thereof, so that the furnace requires an upper space and a lower space, as passages for the hot air, above and below the central portion, respectively. These spaces adversely increase the height of the furnace.

Accordingly, the problem is such that furnace bodies having a large height have to have a dividable structure in order to be transferred from a manufacturing plant to a place to be delivered.

In addition, a heating zone for heating and increasing the temperature of heating targets requires a larger amount of heat, or larger amount of air and greater air speed, than a soaking zone where increased temperature is maintained uniformly. Thus, in order to distribute a larger amount of hot air, expelled from a fan, to the heating zone than to the soaking zone, a fixed-type inner cylinder has to be installed in the central portion of the furnace. This unfavorably results in a complicated structure of a rotation hearth.

Instead of installing the fixed-type inner cylinder, the soaking zone can be provided with an amount of air and an air speed corresponding to those in the heating zone. However, such an arrangement is obliged to supply to the soaking zone an exceedingly large amount of air and a high air speed, thereby adversely requiring a fan provided with larger capacity.

It is therefore an object of the present invention to provide a rotary heat treatment furnace that is provided with a furnace body having a reduced height while the number of housing chambers in the height direction is not reduced, that has a rotary hearth of a simple structure, and that can have a fan provided with reduced capacity.

Disclosure of the Invention

The present invention has been accomplished to achieve the objects described above. A rotary heat treatment furnace (30) according to a first aspect of the present invention includes:

a furnace body (31) having an inside that is partitioned into a first zone (80) and a second zone (90);

a housing rotary body (32) rotatably supported and disposed so as to straddle the first zone (80) and the second zone (90), the housing rotary body (32) including: a plurality of side walls (32*c*) extending radially; a plurality of housing chambers (32*a*) partitioned by the side walls (32*c*), the housing chambers (32*a*) each having a substantially same size, the housing chambers (32*a*) being disposed circumferentially in multiple stages, each of the multiple stages including multiple housing chambers (32*a*); and a space (32*b*) disposed in the central portion of the housing rotary body (32) so that the housing rotary body (32) is provided with a donut shape in plan view;

a rotary driving device (33) for rotating the housing rotary body (32);

a heating device (39) for heating the air inside the furnace body (31);

a fan (34) for feeding hot air prepared by the air heated by the heating device (39) to the housing rotary body (32);

a first partition wall (37) and a second partition wall (38), the first partition wall (37) extending from the fan (34) to the housing rotary body (32) while the second partition wall (38) extending from a wall surface of the furnace body (31) to the housing rotary body (32), the first partition wall (37) and the second partition wall (38) together partitioning the inside of the furnace body (31) into the first zone (80) and the second zone (90);

a first flow passage (35) communicating a blowout port of the fan (34) with outer circumference sides of the housing chambers (32*a*) positioned in the first zone (80); and a second flow passage (36) communicating outer circumference sides of the housing chambers (32*a*) positioned in the second zone (90) with a suction port of the fan (34), wherein:

when the first partition wall (37) is in such a state that an end portion thereof at a side of the housing rotary body (32) side comes closer to one of the side walls (32*c*), the second partition wall (38) is in such a state that an end portion thereof at a side of the housing rotary body (32) comes closer to another one of the side walls (32*c*);

the hot air provided by the fan (34) and passed through the first flow passage (35) is fed substantially horizontally to the outer circumference sides of the housing chambers (32*a*) positioned in the first zone (80) and further to the space (32*b*) side; and the hot air is then fed substantially horizontally from the space (32*b*) side to the outer circumference sides of the housing chambers (32*a*) positioned in the second zone (90), and is returned to the fan (34) through the second flow passage (36).

A rotary heat treatment furnace (30) according to a second aspect of the present invention is such that the first partition wall (37) and the second partition wall (38) are disposed so that the first zone (80) includes a larger number of the housing chambers (32*a*) than the second zone (90), whereby each of the housing chambers (32*a*) in the second zone (90) is provided with larger amount and faster speed of the hot air than each of the housing chambers (32*a*) in the first zone (80).

A rotary heat treatment furnace (30) according to a third aspect of the present invention is such that the furnace (30) includes a carriage port (41) for carrying in and carrying out heating targets to and from the housing chambers (32*a*), the carriage port (41) being provided to a portion of a wall of the furnace body (31), the portion being located at the rotationally downstream-most of the housing rotary body (32) in the first zone (80).

A rotary heat treatment furnace (30) according to a fourth aspect of the present invention is such that the furnace (30) further includes a flow control plate (42) provided to an upstream side of the carriage port (41) so as to control or restrain the hot air flowing into the housing chamber (32*a*) facing the carriage port (41).

A rotary heat treatment furnace (30) according to a fifth aspect of the present invention is such that the furnace (30) includes a temperature rising device disposed in the space (32*b*) formed in the central portion of the housing rotary body (32), the temperature rising device being configured to increase the temperature of the hot air to be fed from the space (32*b*) side to the second zone (90), the temperature rising device using a heat source that is independent from the heating device (39).

A rotary heat treatment furnace (30) according to a sixth aspect of the present invention is such that the temperature rising device comprises a heat supply pipe (50) that is provided in and along the space (32*b*) formed in the central portion of the housing rotary body (32), the heat supply pipe (50) being provided with a plurality of openings (51) at a circumference surface thereof at a side of the second zone (90), the heat supply pipe (50) being configured to feed therethrough a gas supplied from an outside of the furnace body (31) to the second zone (90) side, the gas having a higher temperature than the hot air flowing from the first zone (80) into the space (32*b*).

A rotary heat treatment furnace (30) according to a seventh aspect of the present invention is such that the temperature rising device is communicated with a solution treatment furnace (60), and the high temperature gas fed from the outside of the furnace body (31) is an exhaust gas discharged from the solution treatment furnace (60).

The reference signs each in the corresponding parentheses indicate a corresponding element or matter described in the figures and the embodiments of the present invention to be introduced later.

Advantageous Effects of Invention

The rotary heat treatment furnace according to the first aspect of the present invention includes: the housing chambers partitioned by the side walls extending radially; the first partition wall extending from the fan to the housing rotary body and the second partition wall extending from the wall surface of the furnace body to the housing rotary body, so that the first and second partition walls together partition the inside of the furnace body into the first and second zones; the first flow passage communicating the blowout port of the fan with the outer circumference surface sides of the housing chambers positioned in the first zone; and the second flow passage communicating the outer circumference sides of the housing chambers positioned in the second zone with the suction port of the fan. This arrangement allows the hot air to be fed substantially horizontally from the outer circumference sides of the housing chambers in the first zone to the space side, and is further fed substantially horizontally from the space side to the outer circumference sides of the housing chambers in the second zone.

Specifically, the hot air is fed substantially horizontally with respect to the housing chambers, which can advantageously exclude formation of any space, used for a hot air passage, above and below the central portion of the housing rotary body. This allows the furnace body to have a reduced height without reducing the number of the housing chambers in the height direction. Accordingly, the furnace body can be transported only with a minimum number of members being removed, the members including the rotary driving device, the heating device such as the burner, and the fan.

In addition, the hot air is fed from the first zone to the second zone, so that an installation of the fixed-type inner cylinder in the central portion of housing rotary body, which is conventionally required and is used for distributing the hot air into the first and second zones, can be excluded. With such an arrangement the rotary hearth can have a simpler structure, and favorably allows the selection of a fan provided with not-large volume.

Furthermore, the furnace body has a reduced height thus has a reduced volume, which reduces heat loss of the furnace body, thereby leading to energy saving.

Moreover, the housing chambers in the first zone are provided with the hot air having a temperature that is not decreased, which provides little temperature variation in the housing chambers in the first zone.

The rotary heat treatment furnace according to the second aspect of the present invention is such that the first and second partition walls are disposed so that the first zone includes more housing chambers than the second zone. Thus, the hot air flowing into each of the housing chambers in the second zone has a larger amount and faster speed than the hot air flowing into each of the housing chambers in the first zone. This, in addition to the advantageous effects of the first aspect of the present invention, increases the heat transfer coefficient in the second zone, thereby swiftly increasing the temperature of the heating targets in the housing chambers in the second zone.

The rotary heat treatment furnace according to the third aspect of the present invention includes the carriage port for carrying in and out the heating targets to and from the housing chambers. The carriage port is provided to a certain portion of the wall of the furnace body, and the certain portion is located at the rotationally downstream-most of the housing rotary body in the first zone. This arrangement is able to prevent or restrain leakage of the heat from the carriage port, in addition to the advantageous effects of the first and the second aspects of the present invention.

That is, the hot air in the first zone has a smaller amount and a lower speed than the hot air in the second zone, so that the heat loss through the carriage port during the carrying-in and carrying-out operations of the heating targets can be restrained.

The rotary heat treatment furnace according to the fourth aspect of the present invention includes the flow control plate that is disposed upstream side of the carriage port, which plate controls or restrains the hot air flowing into the housing chamber facing the carriage port. In addition to the advantageous effects of the first to the third aspects of the present invention, such an arrangement allows further control or restraint of the heat loss through the carriage port, thereby excluding an installation of a duct system around the carriage port.

The rotary heat treatment furnace according to the fifth aspect of the present invention is such that the temperature rising device, which uses a heat source independent from the heating device, is provided in the space formed in the central portion of the housing rotary body to increase the temperature of the hot air to be fed from the space side to the second zone. Thus, in addition to the advantageous effects of the first to the fourth aspect of the present invention, this arrangement successfully increases the atmospheric temperature of the second zone, thereby further swiftly increasing the temperature of the heating targets in the housing chambers in the second zone.

The rotary heat treatment furnace according to the sixth aspect of the present invention is such that the temperature rising device includes the heat supply pipe provided along the space formed in the central portion of the housing rotary body. In addition, the heat supply pipe is provided with the plurality of openings at the circumference surface thereof at a side of the second zone. With these arrangements, the gas having a temperature higher than that of the hot air flowing from the first zone into the space is fed from the outside of the furnace body to the second zone side via the heat supply pipe and the openings thereof. Thus, in addition to the advantageous effects of the fifth aspect of the present invention, it becomes possible to swiftly increase the atmospheric temperature of the second zone with a simple structure.

Furthermore, the amount of the hot air can be adjusted by changing the opening degree of the openings formed in the heat supply pipe, whereby the atmospheric temperature of the second zone can be controllably set to a desired temperature with ease.

The rotary heat treatment furnace according to the seventh aspect of the present invention is such that the temperature rising device is communicated with the solution treatment furnace, and the exhaust gas discharged from the solution treatment furnace is used as the high temperature gas fed from the outside of the furnace body. Thus, effective use of energy can be accomplished, in addition to the advantageous effects of the sixth aspect of the present invention.

It should be noted that none of Japanese Unexamined Patent Publication Nos. 2011-7471 and 2004-257658 mentioned above describes at all a feature of the rotary heat treatment furnace of the present invention, wherein the hot air is fed substantially horizontally from the outer circumference sides of the housing chambers positioned in the first zone to the space side, and is further fed substantially horizontally from the space side to the outer circumference sides of the housing chambers positioned in the second zone.

DETAILED DESCRIPTION

Figure 1:
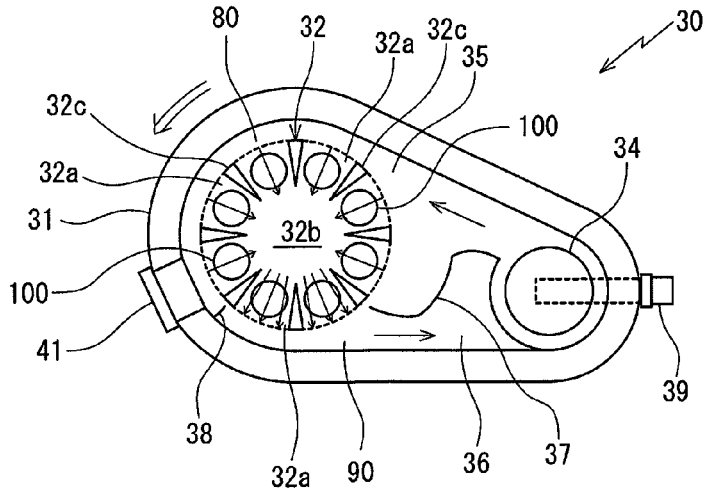
FIG. 1 is a plan view illustrating a rotary heat treatment furnace according to an embodiment of the present invention.
Figure 2:
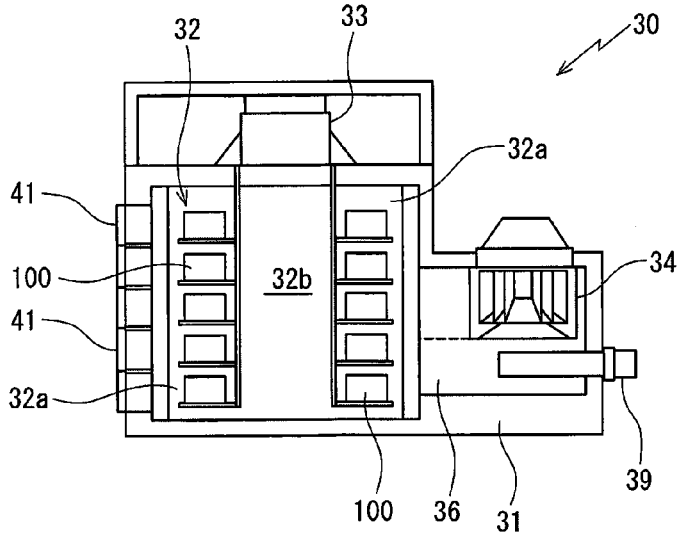
FIG. 2 is a vertical sectional view illustrating the rotary heat treatment furnace according to the embodiment of the present invention.

A rotary heat treatment furnace 30 according to an embodiment of the present invention will be described with reference to FIGS. 1 and 2.

The rotary heat treatment furnace 30 is used to apply heat treatment to heating targets 100 such as an aluminum alloy, and includes a furnace body 31, a housing rotary body 32, a rotation driving device 33, a burner 39 as a heating device, a fan 34, a first flow passage 35 and a second flow passage 36.

The rotary heat treatment furnace 30 of the embodiment has a special feature in the direction or orientation in the re-circulation of the hot air supplied to heating targets 100.

The furnace body 31 accommodates mainly the housing rotary body 32 and the fan 34. The furnace body 31 is provided with heat insulation treatment so that heat inside the furnace body 31 is prevented from escaping outside.

The furnace body 31 is provided inside thereof with a first partition wall 37 and a second partition wall 38. The first partition wall 37 extends from the fan 34 to the housing rotary body 32, while the second partition wall 38 extends from a wall surface of the furnace body 31 to the housing rotary body 32. The first partition wall 37 and the second partition wall 38 together partition the inside of the furnace body 31 into a first zone 80 and a second zone 90. The first zone 80 takes a place at a side of a blowout port of the fan 34, while the second zone 90 takes a place at a side of a suction port of the fan 34.

The first and second partition walls 37, 38 extend from the hearth of the furnace to the ceiling thereof, so that hot air in the first zone 80 does not directly flow over the first and second partition walls 37, 38 into the second zone 90, and vise versa.

A carriage port 41 is provided to carry in and out heating targets 100 into and from the housing chamber 32*a*. Specifically, the carriage port 41 is provided to a part of a wall of the furnace body 31, the part corresponding to the rotational downstream-most of the housing rotary body 32 in the first zone 80.

The housing rotary body 32 includes a plurality (eight in this embodiment) of housing chambers 32*a* circumferentially disposed in a multistage form, and further includes at a central portion thereof a space 32*b*, thereby forming a substantially doughnut shape in plan view. The housing rotary body 32 is rotationally disposed and supported inside the furnace body 31 so as to straddle over the first zone 80 and the second zone 90 (between the first and second partition walls 37, 38).

Specifically, the housing rotary body 32 is hung down from the rotary driving device 33 and is rotatably supported by the rotary driving device 33. Thus, the housing rotary body 32 does not contact the furnace body 31 at the upper and lower ends of the housing rotary body 32, or has a little frictional resistance in case of a contact.

The housing chambers 32*a* each have a fan shape in plan view with a substantially same size, and are circumferentially partitioned by side walls 32*c* extending in the radial direction. The housing chambers 32*a* each store inside thereof a heating target 100.

The housing rotary body 32 is disposed with respect to the first and second partition walls 37, 38 so that the first zone 80 is provided with six housing chambers 32*a* while the second zone 90 is provided with two housing chambers 32*a*, in plan view.

In the rotation of the housing rotary body 32, when the first partition wall 37 is in such a state that one end portion thereof at a side of the housing rotary body 32 comes closer to a side of the outer circumference surface of one of the side walls 32*c*, the second partition wall 38 comes in such a state that one end portion thereof at a side of the housing rotary body 32 comes closer to the outer circumference surface of another one of the side walls 32*c*.

That is, the first partition wall 37 and one of the side walls 32*c* together configure a single line of partition wall, while the second partition wall 38 and another one of the side walls 32*c* together configure another single line of partition wall. These two single lines of partition walls partition the inside of the furnace body 31 into the first zone 80 and the second zone 90.

The rotary driving device 33 is installed on the furnace body 31 and functions as a power source to drive the housing rotary body 32.

The rotary driving device 33 in this embodiment rotates the housing rotary body 32 in the counterclockwise direction in plan view.

The rotary driving device 33 is not under operation when one of the housing chambers 32*a* comes to the front of the carriage port 41. The rotary driving device 33, after a predetermined nonoperational period passes, rotates the housing rotary body 32 for a one-eighth turn, and then terminates the rotation. The rotary driving device 33, after a predetermined nonoperational period passes, again rotates the housing rotary body 32 for a one-eighth turn.

The rotary driving device 33 repeats the operational movement and the nonoperational movement alternately to rotate the housing rotary body 32 intermittently.

The fan 34 is provided to an internal end of the furnace body 32 and transfers hot air provided from the burner 39 that heats the air inside the furnace body 31 (in place of the burner 39, other heat sources such as, for example, a heater capable of heating the air inside the furnace body 31 can be used). For achievement of such a function, the fan 34 is disposed so that the blowout port thereof faces a side of the housing rotary body 32 and the suction port thereof faces a side of the burner 39.

Fans that can be used as the fan 34 include an axial flow fan and a sirocco radical fan.

In addition, the blowout port of the fan 34 is positioned at a height corresponding to the substantially vertical center of the housing rotary body 32.

The first flow passage 35 communicates the blowout port of the fan 34 with the outer circumference sides of the housing chambers 32*a* positioned in the first zone 80.

The second flow passage 36 communicates the outer circumference sides of the housing chambers 32*a* positioned in the second zone 90 with the suction port of the fan 34.

Re-circulation of the hot air in the rotary heat treatment furnace 30 configured as described above will be described.

First, the hot air from the fan 34 is supplied to the housing rotary body 32 through the first flow passage 35.

The supplied hot air is fed substantially horizontally from the outer circumference sides of the housing chambers 32*a* positioned in the first zone 80 toward the space 32*b*.

Then, the hot air is fed substantially horizontally from the space 32*b* toward the outer circumference sides of the housing chambers 32*a* positioned in the second zone 90.

Consequently, the hot air returns to the fan 34 through the second flow passage 36.

The hot air is not necessarily fed horizontally in the entire area of the first and second flow passages 35, 36, but the hot air is fed or flows horizontally in the housing chambers 32*a*, from the outer circumference sides of the chambers 32*a* toward the space 32*b* and from the space 32*b* toward the outer circumference sides of the housing chambers 32*a*.

The first zone 80 accommodates a larger number of housing chambers 32*a* than the second zone 90 (six chambers in the first zone 80 and two chambers in the second zone 90), so that the hot air flowing in each of the housing chambers 32 in the second zone 90 has an increased larger amount and faster speed than the hot air flowing in each of the housing chambers 32 in the first zone 80.

Such an arrangement designates the second zone 90 as a heating zone where the heating targets 100 are heated and provided with an increased temperature, while this arrangement designates the first zone P as a soaking zone where the increased temperature of the heating targets 100 is maintained.

The rotary heat treatment furnace 30 described above includes the housing chambers 32*a* partitioned by the side walls extending radially, the first partition wall 37 extending radially from the side of the fan 34 to the housing rotary body 32, the second partition wall 38 extending from the wall surface of the furnace body 31 to the housing rotary body 32, the first partition wall 37 and the second partition 38 together partitioning the inside of the furnace body 31 into the first zone 80 and the second zone 90, the first flow passage 35 communicating the blowout port of the fan 34 with the outer circumference sides of the housing chambers 32*a* in the first zone 80, and the second flow passage communicating the outer circumference sides of the housing chambers 32*a* in the second zone 90 with the suction port of the fan 34. Thus, the hot air is fed horizontally from the outer circumference sides of the housing chambers 32*a* in the first zone 80 toward the space 32*b*, and is then fed horizontally from the space 32*b* to the outer circumference sides of the housing chambers 32*a* in the second zone 90.

It should be noted that the hot air is fed substantially horizontally to the housing chambers 32*a*, so that the housing rotary body 32 does not require any space above or below the central portion thereof for feeding the hot air. This allows the furnace body 31 to have a reduced height without a reduction of the number of the housing chambers 32*a* in the height direction. Consequently, the furnace body 31 can be transported with removal of a minimum number of members such as the rotary driving device 33 and the fan 34, keeping other members in assembled positions.

In addition, the hot air is fed from the first zone 80 to the second zone 90, so that a fixed-type inner cylinder disposed in the central portion of the housing rotary body 32 in the prior example can be excluded, the inner cylinder being used to distribute the hot air from the fan 34 into the first zone 80 and the second zone 90. This can simplify the structure of the rotary hearth and favorably allows the selection of a fan provided with smaller capacity.

Furthermore, the furnace body 31 of reduced height reduces the volume thereof, thereby leading to reduced heat loss and energy saving.

Moreover, the housing chambers 32*a* in the first zone 80 are provided with the hot air with a temperature that has not been decreased, so that the housing chambers 32 in the first zone 80 are not involved in a temperature variation.

The first and second partition walls 37, 38 are disposed so that the first zone 80 can accommodate a larger number of housing chambers 32 than the second zone 90, whereby each of the housing chambers 32*a* in the second zone 90 is provided with the hot air of a greater amount and a faster speed than those provided to each of the housing chambers 32*a* in the first zone 80. Such an arrangement improves the heat transfer coefficient in the second zone 90, thereby swiftly increasing the temperature of the heating targets 100 in the housing chambers 32*a* in the second zone 90.

In addition, the carriage port 41 for carrying in and out the heating targets 100 into and from the corresponding housing chamber 32*a* is provided to a portion of the wall of the furnace body 31, which portion is located at the rotationally downstream-most of the housing rotary body 32 in the first zone 80. This arrangement is able to prevent or restrain leakage of the heat from the carriage port 41.

That is, the hot air in the first zone 80 has less amount and slower speed than the hot air in the second zone 90, so that heat loss through the carriage port 41 during the carrying-in and carrying-out operations of the heating targets 100 can be restrained.

It should be noted that in this embodiment, the first zone 80 contains six housing chambers 32*a* while the second zone 90 contains two housing chambers 32*a*, in a plan view. The present invention, however, is not limited to such an arrangement and can include other arrangements where the second zone 90 contains, at least, a larger number of housing chambers 32 than the first zone 80.

In the abovementioned arrangement, the first zone 80 is provided with a larger number of the housing chambers 32*a* than the second zone 90, thereby substantially providing a throttle mechanism. Instead of such an arrangement, a wall provided with a hole can also provide the throttle mechanism (or a nozzle mechanism).

Furthermore, in this embodiment, the carriage port 41 is provided to a portion of the wall of the furnace body 31, the portion being located at the rotational downstream-most of the housing rotary body 32 in the first zone 80. The position of the carriage port 41, however, is not limited to such a location.

Figure 3:
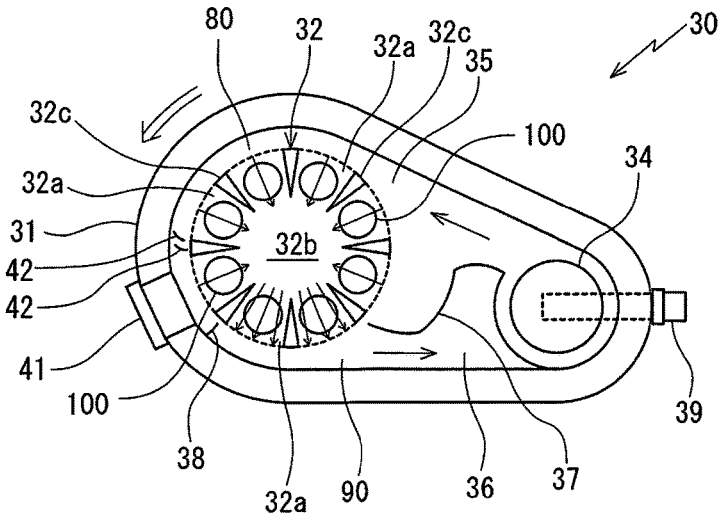
FIG. 3 is a plan view illustrating a rotary heat treatment furnace according to another embodiment of the present invention.
Figure 4:
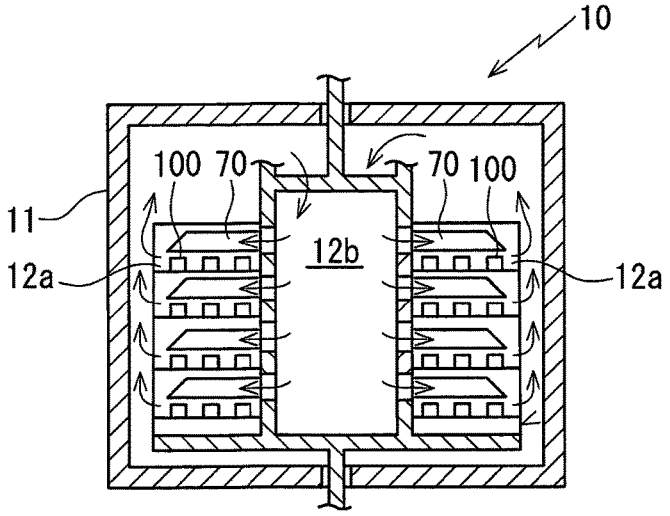
Fig. 4 PRIOR ART
FIG. 4 is a vertical cross sectional view illustrating a rotary heat treatment furnace according to a prior example.
Figure 5:
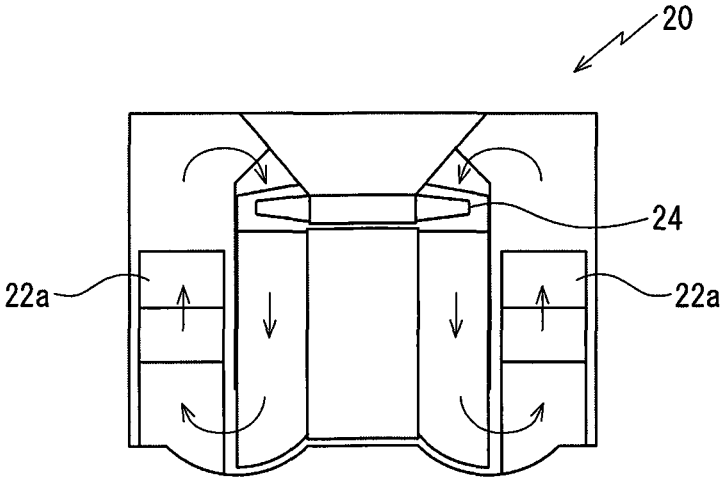
Fig. 5 PRIOR ART
FIG. 5 is a vertical cross sectional view illustrating a rotary heat treatment furnace according to another prior example.

In addition, as illustrated in FIG. 3, flow control plates 42 may be provided to a position upstream of the carriage port 41 of the housing rotary body 32 to restrain the flow of the hot air into the housing chamber 32*a* facing the carriage port 41. This arrangement can further restrain the heat loss through the carriage port 41 during the carrying-in and carrying-out operations of the heating targets 100, and can exclude a duct system around the carriage port 41.

Furthermore, the flow control plate 42 may be provided in a desired position in the first flow passage 35 to control the amount and flow speed of the hot air.

Moreover, the second partition wall 38 is provided to the wall surface of the furnace body 31 so as to project toward a side of the housing rotary body 32. In place of such an arrangement, another arrangement may be allowed wherein any member is provided to form a continuous partition wall with one of the side walls 32*c* which partition the inside of the furnace body 31 into the first zone 80 and the second zone 90.

Furthermore, although the housing rotary body 32 in this embodiment is provided with a hung-down style, any other styles can be employed.

Figure 6:
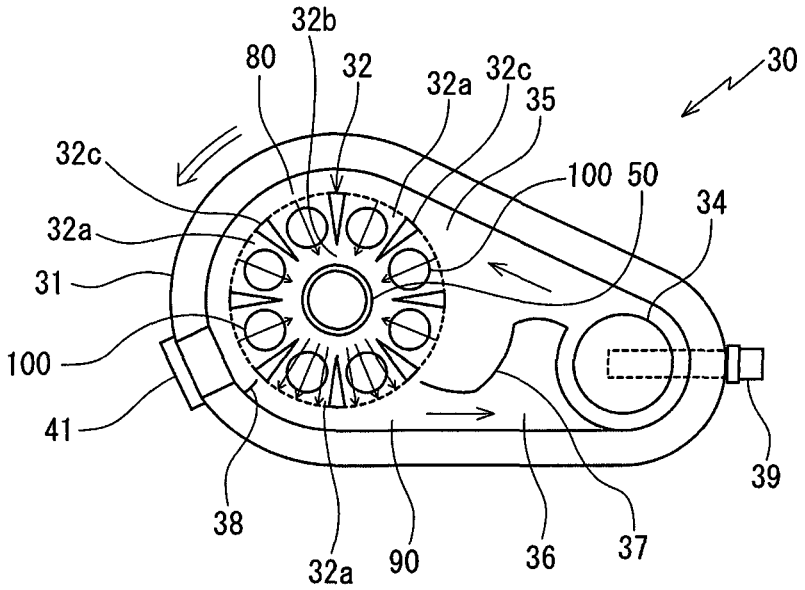
FIG. 6 is a plan view illustrating a rotary heat treatment furnace according to still another embodiment of the present invention.

In addition, the arrangement in this embodiment is such that the air heated by a heating device such as the burner 39 is fed in the form of the hot air by the fan 34 disposed at the internal end of the furnace body 31 into the housing rotary body 32 through the first flow passage 35, and is then fed to the housing chambers 32*a* in the first zone 80 and to the housing chambers 32*a* in the second zone 90. This arrangement can be modified into another arrangement wherein a temperature rising device, which uses a heat source that is independent from the heating device such as the burner, is disposed in the space 32*b* formed in the central portion of the housing rotary body 32 to increase the temperature of the hot air fed from a side of the space 32*b* to the second zone 90. More specifically, as illustrated in FIGS. 6 to 8, the temperature rising device may be formed of a heat supply pipe 50 and disposed in or along the space 32*b* in the central portion of the housing rotary body 32 to thereby directly feed the hot air into the inside of the housing rotary body 32.

Figure 7:
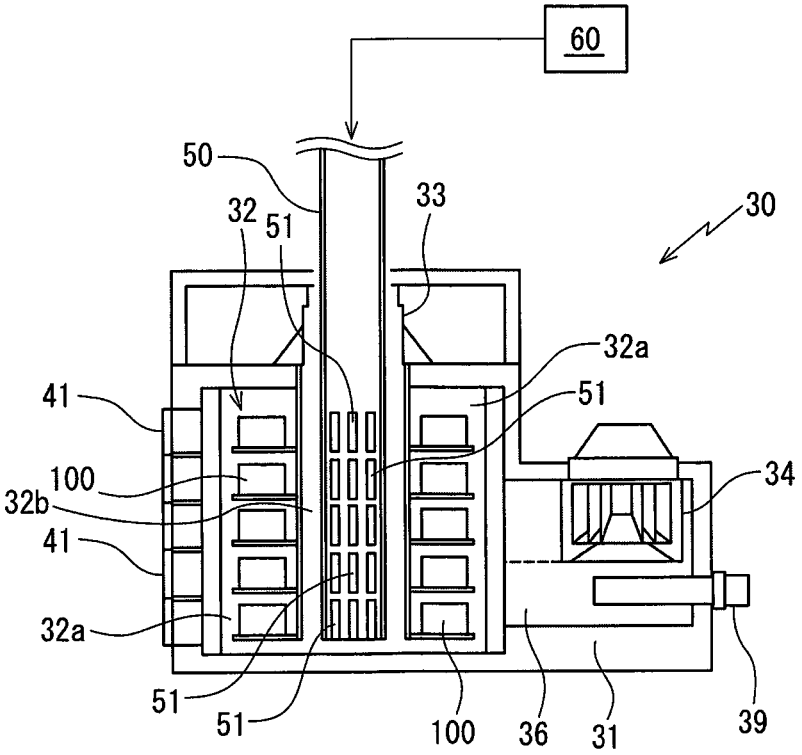
FIG. 7 is a vertical sectional view illustrating a rotary heat treatment furnace according to still another embodiment of the present invention.
Figure 8:
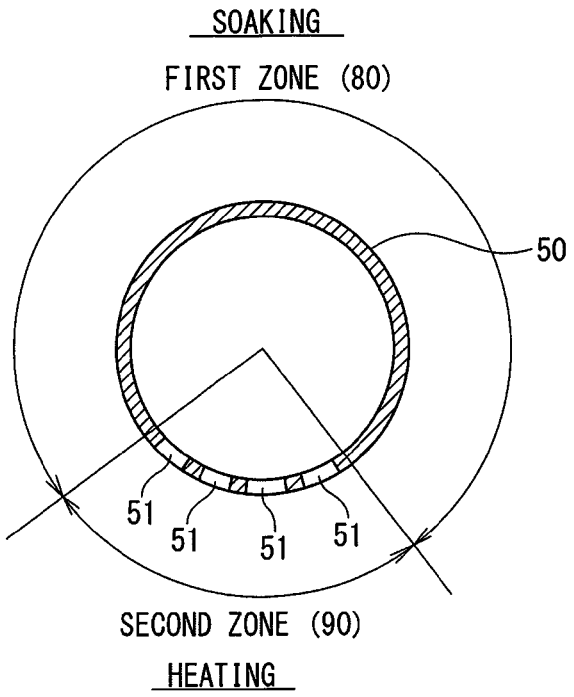
FIG. 8 is an enlarged cross sectional view of the heat supply pipe illustrated in FIG. 7.

As illustrated in FIGS. 7 and 8, the heat supply pipe 50 has a tubular shape extending vertically and is provided with openings 51 at a circumference portion thereof at a side of the second zone 90. The heat supply pipe 50 is configured to feed therethrough a gas, having a higher temperature than the hot air flowing from the first zone 80 into the space 32*b*, into the second zone 90 from the outside of the furnace body 31. In this embodiment, the heat supply pipe 50 is provided at a side of the second zone 90 and includes twenty openings 51 each having a substantially rectangular shape, out of twenty openings 51, four being provided in the lateral direction and five in the vertical direction. Specifically, the openings 51 are provided only to a narrower area (at a side of the second flow passage 36) among the two areas partitioned by the first partition wall 37 and the second partition wall 38. The openings 51 may be provided with shutter(s) or valve(s) to change the opening degree thereof, so that the amount of the hot air discharged from the openings 51 can be adjusted. With such an arrangement, it becomes easy to controllably set the atmospheric temperature of the second zone 90 to a desired temperature.

In addition, the heat supply pipe 50 is connected to a solution treatment furnace 60 disposed outside the rotary heat treatment furnace 30 independently from the furnace 30. The heat supply pipe 50 is configured such that the hot air obtained from the heat of exhaust gas discharged from the solution treatment furnace 60 is fed through the pipe 50 into the housing rotary body 32 of the rotary heat treatment furnace 30.

Figure 9:
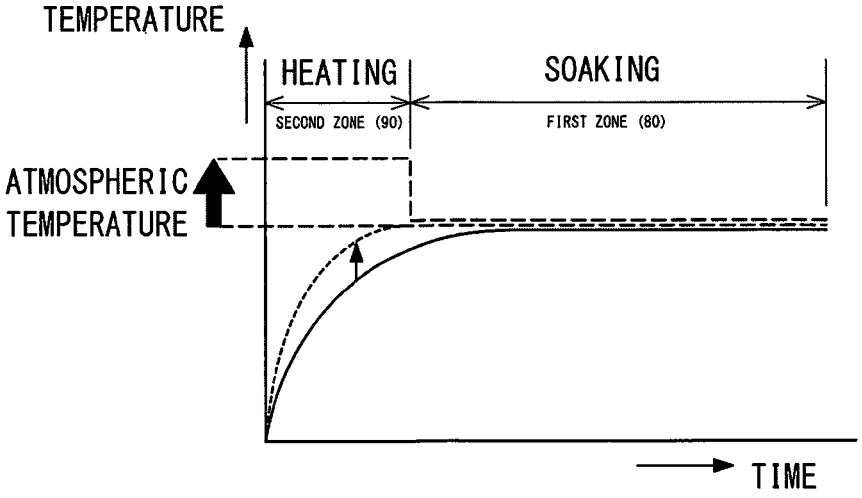
FIG. 9 is a graph indicating a temperature increase caused by hot air exhausted from the heat supply pipe illustrated in FIG. 7.

FIG. 9 illustrates the variation example of the atmospheric temperate and the temperature of the heating targets in the first zone 80 and the second zone 90, when the heat supply pipe 50 is provided and when the heat supply pipe 50 is not provided.

As illustrated in the figure, when the heat supply pipe 50 is provided, the atmospheric temperature in the second zone 90 can be increased more than that in the first zone 80.

In this embodiment, the atmospheric temperature in the second zone 90 was about 143 to 153 centigrade (° C.) when the heat supply pipe 50 was not provided, while the atmospheric temperature in the second zone 90 increased to about 155 to 165 centigrade (° C.) when the heat supply pipe 50 was provided.

Accordingly, it is obvious that a furnace provided with the heat supply pipe 50 is able to swiftly increase the temperature of the heating targets 100 in the housing chambers 32*a* in the second zone 90 much more than a furnace not provided with the heat supply pipe 50.

We claim:

1. A rotary heat treatment furnace comprising: a furnace body having an inside that is partitioned into a first zone and a second zone; a housing rotary body rotatably supported and disposed so as to straddle the first zone and the second zone, the housing rotary body including: a plurality of side walls extending radially; a plurality of housing chambers partitioned by the side walls, the housing chambers each having a substantially same size, the housing chambers being disposed circumferentially in multiple stages, each of the multiple stages including multiple housing chambers; and a space disposed in the central portion of the housing rotary body so that the housing rotary body is provided with a donut shape in plan view; a rotary driving device for rotating the housing rotary body; a heating device for heating the air inside the furnace body; a fan for feeding hot air prepared by the air heated by the heating device to the housing rotary body; a first partition wall and a second partition wall, the first partition wall extending from the fan towards the housing rotary body while the second partition wall extending from a wall surface of the furnace body towards the housing rotary body, the first partition wall and the second partition wall together partitioning the inside of the furnace body into the first zone and the second zone; a first flow passage communicating a blowout port of the fan with outer circumference sides of the housing chambers positioned in the first zone; and a second flow passage communicating outer circumference sides of the housing chambers positioned in the second zone with a suction port of the fan, wherein: when the first partition wall is in such a state that an end portion thereof at a side of the housing rotary body side comes closer to one of the side walls, the second partition wall is in such a state that an end portion thereof at a side of the housing rotary body comes closer to another one of the side walls; the hot air provided by the fan and passed through the first flow passage is fed substantially horizontally to the outer circumference sides of the housing chambers positioned in the first zone and further to the space side; and the hot air is then fed substantially horizontally from the space side to the outer circumference sides of the housing chambers positioned in the second zone, and is returned to the fan through the second flow passage.

2. The rotary heat treatment furnace according to claim 1, wherein the first partition wall and the second partition wall are disposed so that the first zone includes a larger number of the housing chambers than the second zone, whereby each of the housing chambers in the second zone is provided with larger amount and faster speed of the hot air than each of the housing chambers in the first zone.

3. The rotary heat treatment furnace according to claim 1, wherein the furnace further comprising a carriage port for carrying in and carrying out heating targets to and from the housing chambers, the carriage port being provided to a portion of a wall of the furnace body, the portion being located at the rotationally downstream-most of the housing rotary body in the first zone.

4. The rotary heat treatment furnace according to claim 2, wherein the furnace further comprising a carriage port for carrying in and carrying out heating targets to and from the housing chambers, the carriage port being provided to a portion of a wall of the furnace body, the portion being located at the rotationally downstream-most of the housing rotary body in the first zone.

5. The rotary heat treatment furnace according to claim 3, wherein the furnace further comprises a flow control plate provided to an upstream side of the carriage port so as to control or restrain the hot air flowing into the housing chamber facing the carriage port.

6. The rotary heat treatment furnace according to claim 4, wherein the furnace further comprises a flow control plate provided to an upstream side of the carriage port so as to control or restrain the hot air flowing into the housing chamber facing the carriage port.

7. The rotary heat treatment furnace according to claim 1, wherein the furnace further comprises a temperature rising device disposed in the space formed in the central portion of the housing rotary body, the temperature rising device being configured to increase the temperature of the hot air to be fed from the space side to the second zone, the temperature rising device using a heat source that is independent from the heating device.

8. The rotary heat treatment furnace according to claim 7, wherein the temperature rising device comprises a heat supply pipe that is provided in and along the space formed in the central portion of the housing rotary body, the heat supply pipe being provided with a plurality of openings at a circumference surface thereof at a side of the second zone, the heat supply pipe being configured to feed therethrough a gas supplied from an outside of the furnace body to the second zone side, the gas having a higher temperature than the hot air flowing from the first zone into the space.

9. The rotary heat treatment furnace according to claim 8, wherein the temperature rising device is communicated with a solution treatment furnace, and the high temperature gas fed from the outside of the furnace body is an exhaust gas discharged from the solution treatment furnace.

* * * * *